US012168562B2

(12) United States Patent
Rosales

(10) Patent No.: US 12,168,562 B2
(45) Date of Patent: Dec. 17, 2024

(54) CONTAINER FOR COOLING FOOD AND METHOD FOR CONSTRUCTION

(71) Applicant: Abel1950 Inc., San Francisco, CA (US)

(72) Inventor: Nancy Rosales, San Francisco, CA (US)

(73) Assignee: Abel1950 Inc., San Francisco, CA (US)

( * ) Notice: Subject to any disclaimer, the term of this patent is extended or adjusted under 35 U.S.C. 154(b) by 0 days.

(21) Appl. No.: 18/103,880

(22) Filed: Jan. 31, 2023

(65) Prior Publication Data

US 2024/0253888 A1 Aug. 1, 2024

(51) Int. Cl.

| | |
|---|---|
| ***B65D 77/04*** | (2006.01) |
| ***B65D 5/46*** | (2006.01) |
| ***B65D 5/50*** | (2006.01) |
| ***B65D 5/64*** | (2006.01) |
| ***F25D 11/00*** | (2006.01) |

(52) U.S. Cl.

CPC ..... *B65D 77/0433* (2013.01); *B65D 5/46* (2013.01); *B65D 5/503* (2013.01); *B65D 5/64* (2013.01); *F25D 11/00* (2013.01)

(58) Field of Classification Search

CPC ..... F25D 3/02; F25D 3/08; F25D 2331/081; F25D 2331/804; F25D 11/00; F25D 2303/0843; F25D 2303/0844; F25D 2303/082; F25D 3/06; F25D 3/14; F25D 2201/12; B65D 5/46; B65D 5/503; B65D 5/64; B65D 77/0433; B65D 81/3858; B65D 81/18; B65D 81/3823

USPC ..... 220/592.2, 592.25, 23.87, 23.88, 592.1

See application file for complete search history.

(56) References Cited

U.S. PATENT DOCUMENTS

| | | | | |
|---|---|---|---|---|
| 2,149,412 A * | 3/1939 | Bangs | B65D 81/18 | 62/372 |
| 2,302,639 A * | 11/1942 | Moore | B65D 81/18 | 53/472 |
| 2,467,268 A * | 4/1949 | Merkle | B65D 81/18 | 62/383 |
| 2,927,720 A * | 3/1960 | Adams | B65D 81/3858 | 229/193 |
| 4,200,346 A * | 4/1980 | Belokin, Jr. | B62B 5/0083 | 312/351 |
| 4,424,687 A * | 1/1984 | Morgan | F25D 3/08 | 62/457.1 |

(Continued)

*Primary Examiner* — Steven A. Reynolds
*Assistant Examiner* — Prince Pal
(74) *Attorney, Agent, or Firm* — Dority & Manning, P.A.

(57) ABSTRACT

A container assembly and method for constructing a container assembly is provided. The container assembly includes a base assembly, a tray assembly, and a cooling passage cover wall. The base assembly includes a base wall and a base sidewall, the base wall and the base sidewall together forming a base interior volume at which the tray assembly is positionable. The tray assembly includes a tray base wall and a tray sidewall, the tray base wall and the tray sidewall together forming a tray interior volume. A cooling passage is formed between the tray sidewall and the base sidewall. The cooling passage cover wall is removably positionable to extend between the tray sidewall and the base sidewall over the cooling passage. An opening extends through the tray sidewall, the opening providing fluid communication between the cooling passage and the tray interior volume.

19 Claims, 8 Drawing Sheets

(56) References Cited

U.S. PATENT DOCUMENTS 4,565,074 A * 1/1986 Morgan ..... F25D 3/08 62/464
4,819,793 A * 4/1989 Willard ..... A45C 3/04 383/110
5,052,185 A * 10/1991 Spahr ..... A45C 11/20 62/465
5,493,874 A * 2/1996 Landgrebe ..... F25D 3/08 62/457.2
5,501,338 A * 3/1996 Preston ..... B65D 21/0213 294/149
5,931,019 A * 8/1999 White ..... F25D 3/08 62/457.7
6,050,663 A * 4/2000 Schoellmann ..... F25D 3/08 312/351
6,626,006 B1 * 9/2003 Tedder ..... F25D 3/08 220/915.2
6,763,678 B2 * 7/2004 Harper ..... F25D 3/08 62/461
D608,157 S * 1/2010 White ..... D7/605
8,863,546 B2 * 10/2014 Oberweis ..... F25D 3/14 62/441
D780,453 S 3/2017 Carrasco
9,631,860 B2 * 4/2017 Gossens ..... F25D 11/04
10,099,816 B2 * 10/2018 Summers ..... F25D 3/08
11,655,063 B2 * 5/2023 Sollie ..... B65D 81/3858 220/592.2
11,692,762 B2 * 7/2023 Waltermire ..... B65D 81/3888 206/545
11,697,543 B2 * 7/2023 Aksan ..... B65B 7/20 220/592.2
11,807,420 B2 * 11/2023 Hathaway ..... A45C 11/20
2002/0064318 A1 * 5/2002 Malone ..... B65D 81/3853 383/110
2003/0014994 A1 * 1/2003 Smith ..... F25B 17/02 62/480
2004/0058038 A1 * 3/2004 Lee ..... A47J 47/14 426/107
2005/0035120 A1 * 2/2005 Hull ..... A45C 11/20 220/23.87
2007/0101754 A1 * 5/2007 Maldonado ..... B67D 3/0067 220/592.03
2008/0087037 A1 * 4/2008 Rapaz ..... F25D 3/08 62/457.2
2008/0121630 A1 * 5/2008 Simard ..... A45C 11/20 220/592.2
2008/0178629 A1 * 7/2008 Meether ..... F25D 3/08 220/592.2
2008/0248173 A1 * 10/2008 Hopkins, Sr. ..... B65D 81/3461 426/243
2010/0072211 A1 * 3/2010 Dickinson ..... B65D 81/052 220/62.15
2010/0314397 A1 * 12/2010 Williams ..... B65D 81/3823 220/592.01
2011/0030413 A1 * 2/2011 Heil ..... F24F 5/0017 62/407
2011/0123683 A1 * 5/2011 Sendel ..... B65D 81/3484 426/109
2011/0203297 A1 * 8/2011 Oberweis ..... F25D 3/14 62/383
2013/0256393 A1 * 10/2013 Nouchet ..... B65D 5/003 229/125.02
2014/0000306 A1 * 1/2014 Chapman, Jr. ..... F25D 3/08 229/103.11
2014/0021208 A1 * 1/2014 Anti ..... F25D 3/125 220/592.25
2014/0151382 A1 * 6/2014 White ..... F25D 3/08 220/592.2
2015/0102717 A1 * 4/2015 Furr ..... F25D 25/025 312/404
2015/0276303 A1 * 10/2015 Preciat Cervera ..... F25D 25/00 206/427
2016/0251132 A1 * 9/2016 Peel ..... B65D 71/0003 206/427
2016/0304267 A1 * 10/2016 Aksan ..... B65D 81/3862
2017/0341838 A1 * 11/2017 Gamble ..... A47G 23/0266
2019/0000205 A1 * 1/2019 Carden ..... A45C 15/06
2019/0032991 A1 * 1/2019 Waltermire ..... B65D 25/28
2020/0307895 A1 * 10/2020 Jobe ..... B65D 81/3848 220/592.2
2021/0123653 A1 * 4/2021 Kieling ..... B65D 11/1826
2021/0130075 A1 * 5/2021 Long ..... B65D 81/3851
2021/0188522 A1 * 6/2021 Kilmer ..... F25D 3/06
2021/0347550 A1 * 11/2021 Vezina ..... B65D 71/0088
2023/0159256 A1 * 5/2023 Vezina ..... B65D 71/0096 220/592.26

* cited by examiner

CONTAINER FOR COOLING FOOD AND METHOD FOR CONSTRUCTION

FIELD

The present disclosure is directedly generally to containers and closures, and more specifically to containers for cooling or freezing food or foodstuffs, and more specifically for display and transport containers for food or foodstuffs.

BACKGROUND

Caterers, food delivery personnel, and persons operating in food service transport and display food and foodstuffs, such as to clients for social gatherings, parties, or sales. Food and foodstuffs may require cooling during transportation and while positioned for display, sale, or consumption.

Various containers are utilized for transport and display. Some containers may be constructed for durable, repeated reuse. However, such containers may be undesirable for sin-gle-use or one-way transportation, such as when a food service provider may provide food and the container to a client. Other containers may be constructed as single-use or disposable containers. However, such containers may have poor insulation and may be undesirable for transporting and displaying cold or frozen food and foodstuffs. Disposable containers may become wet from ice or cooling packs, which may expose a user to harm if the ice or cooling pack touches the user. Combinations of durable containers and disposable containers may provide cooling and insulation for transportation and disposable display containers for display. However, such combinations include transportation, logistical, and cost burdens associated with durable containers, and cost burdens associated with utilizing disposable containers and durable containers.

Still various containers, such as refrigerators, freezers, or boxes for displaying or transporting food or foodstuffs, require energy input (e.g., electric plug-in or battery) for cooling or maintaining cooling of contents. Such containers may be unsuitable for outdoor environments, or other environments at which electric energy inputs are inaccessible or poorly accessible.

Accordingly, containers addressing one or more issues described above are desired and would be advantageous. Additionally, improved containers for transporting and displaying food and foodstuffs addressing one or more issues described above is desired. Furthermore, improved insulating containers for transporting and displaying food and foodstuffs is desired.

BRIEF DESCRIPTION

Aspects and advantages of the subject matter will be set forth in part in the following description, or may be understood from the description, or may be learned through practice of the invention.

An aspect of the present disclosure is directed to a container assembly, the container assembly including a base assembly. The base assembly includes a base wall and a base sidewall. The base wall and the base sidewall together form a base interior volume at which a tray assembly is positionable. The tray assembly includes a tray base wall and a tray sidewall. The tray base wall and the tray sidewall together form a tray interior volume. A cooling passage is formed between the tray sidewall and the base sidewall. A cooling passage cover wall is removably positionable to extend between the tray sidewall and the base sidewall over the cooling passage. An opening extends through the tray sidewall, the opening providing fluid communication between the cooling passage and the tray interior volume.

Another aspect of the present disclosure is directed to a container assembly for displaying or transporting food, foodstuffs, or organic matter. The container assembly includes a base assembly. The base assembly includes a base wall and a plurality of base sidewalls. The base wall and the plurality of base sidewalls together form a base interior volume at which a tray assembly is positionable. The tray assembly includes a tray base wall and a plurality of tray sidewalls. The tray base wall and the plurality of tray sidewalls together form a tray interior volume. A cooling passage is formed between one or more pair of tray sidewall and base sidewall. A cooling passage cover wall is removably positionable to extend over the cooling passage. An opening extends through one or more of the tray sidewalls, the opening providing fluid communication between the cooling passage and the tray interior volume.

Yet another aspect of the present disclosure is directed to a method for constructing a container for displaying or transporting food, foodstuffs, or organic matter, the method including forming, from a cardboard, corrugated fiberboard, paperboard, mat board, wood, composite paper or wood material, plant-based fiber, or combinations thereof, a base interior volume from a base assembly including a base wall and a base sidewall; forming, from a cardboard, corrugated fiberboard, paperboard, mat board, wood, composite paper or wood material, or combinations thereof, a tray interior volume from a tray assembly including a tray base wall and a tray sidewall; forming a cooling passage between the tray sidewall and the base sidewall; and forming an opening extending through the tray sidewall from the cooling passage to the interior volume.

These and other features, aspects, and advantages of the present subject matter will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
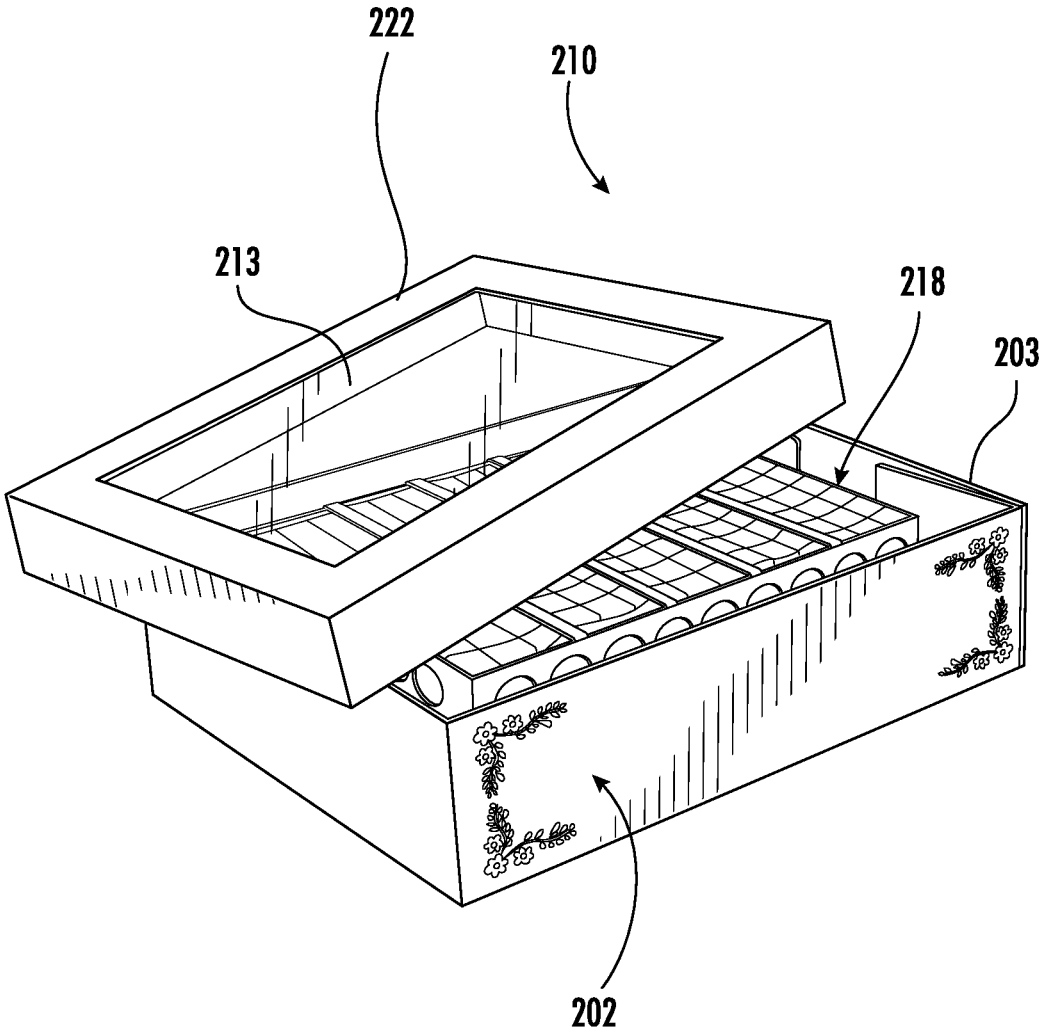
FIG. 1 depicts a perspective view of an exemplary embodiment of a container assembly in accordance with aspects of the present disclosure.
Figure 2:
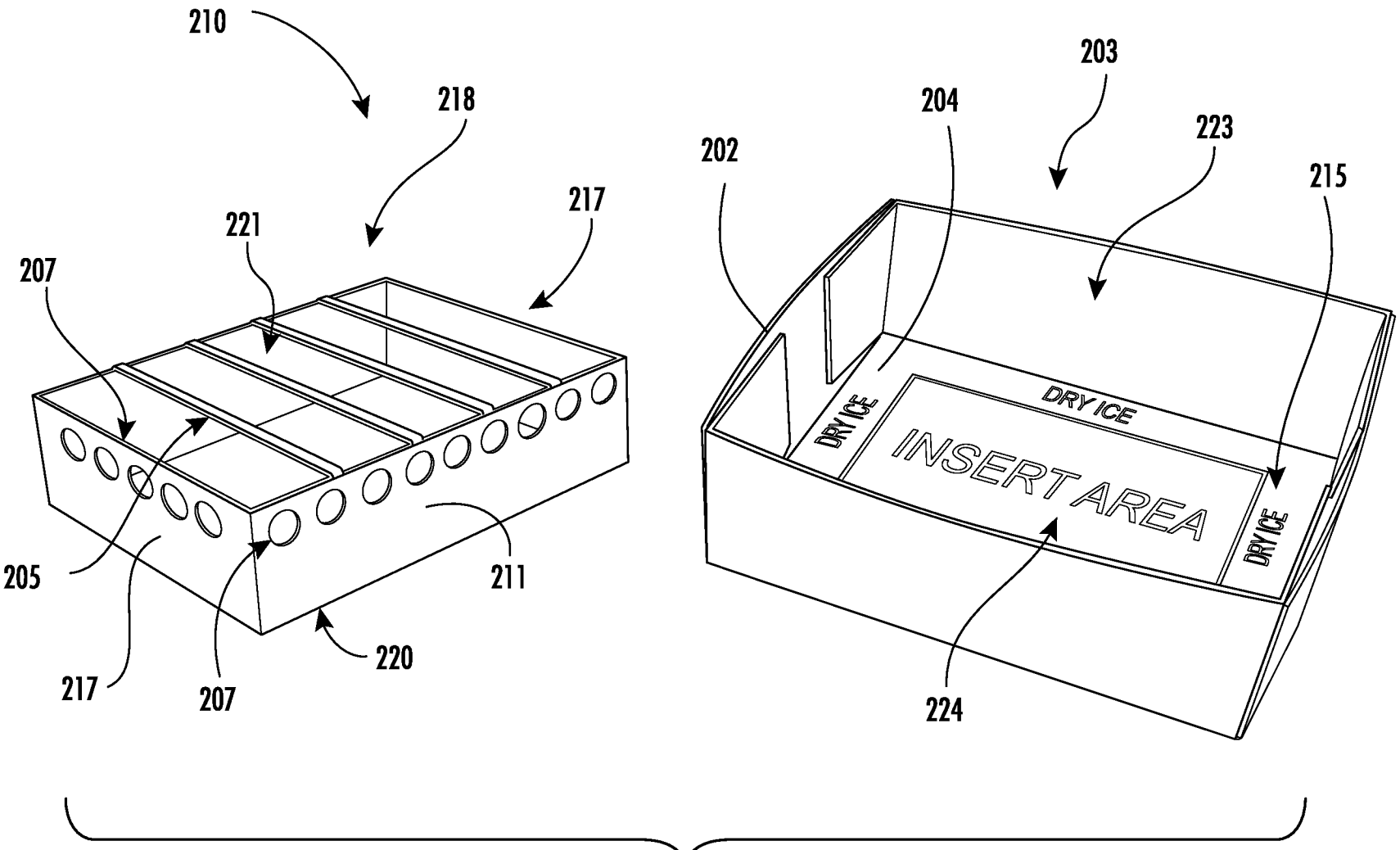
FIG. 2 depicts perspective views of components of an exemplary embodiment of a container assembly in accordance with aspects of the present disclosure.

Repeat use of reference characters in the present specification and drawings is intended to represent the same or analogous features or elements of the present subject matter.

DETAILED DESCRIPTION

Reference now will be made in detail to embodiments of the present subject matter, one or more examples of which are illustrated in the drawings. The word "exemplary" is used herein to mean "serving as an example, instance, or illustration." Any implementation described herein as "exemplary" is not necessarily to be construed as preferred or advantageous over other implementations. Moreover, each example is provided by way of explana-tion, rather than limitation of, the technology. In fact, it will be apparent to those skilled in the art that modifications and variations can be made in the present technology without de-parting from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the subject matter.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Ranges provided herein are inclusive of their end points. For instance, a range of 1 to 100 includes 1 and 100.

Terms of approximation, such as "about," "generally," "approximately," or "substantially," include values within a ten percent full scale error from a lowest value embodiment to a highest value embodiment. For instance, an embodiment including a range from approximately 10 to approximately 100 with a ten percent full scale error may include values from 1 to 109. Additionally, or alternatively, dimensions provided herein may include ranges of 10% greater and/or less than the dimension provided.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

As used herein, "food" refers to food, foodstuffs, organic matter, edible material, or matter generally intended for consumption. However, it should be appreciated that embodiments of the container assembly provided herein may accommodate non-food contents that may require substantially similar cooling conditions as food, such as, but not limited to, plant matter, animal tissue, organic specimen, etc.

Referring to the drawings, FIGS. 1-9 depict embodiments of a container assembly 210 including a base assembly 203, a tray assembly 218, and a cooling passage cover 212. Embodiments depicted and described herein provide advantages and benefits associated with durable containers and disposable containers, such as further described herein.

The base assembly 203 includes a base wall 204 forming a floor or closed face of the base assembly 203. The base assembly 203 includes a plurality of sidewalls 202 forming side faces of the base assembly 203. In various embodiments, the base wall 204 and sidewalls 202 together form an open top face through which a tray assembly 218 is receivable and removable. The base wall 204 and sidewalls 202 together form an interior volume 223 at which the tray assembly 218 is positioned. A reference tray assembly area 224 is defined at the base wall 204. The reference tray assembly area 224 depicts an area over which the tray assembly 218 is positioned into the base assembly 203, such as further described herein. An area at the base wall 204 (e.g., surrounding the reference tray assembly area 224) forms a cooling passage 215, such as further described herein.

The tray assembly 218 includes a tray base wall 220 forming a floor or closed face of the tray assembly 218. The tray assembly 218 includes a plurality of tray sidewalls 211 forming side faces of the tray assembly 218. In various embodiments, the tray base wall 220 and sidewalls 211 together form an open top face through which food is receivable and removable. An interior volume 221 of the tray assembly 218 is formed between the sidewalls 211

The cooling passage 215 is formed between the tray sidewalls 211 and the base sidewalls 202. In various embodiments, the cooling passage 215 extends at least partially around an outer perimeter of the tray assembly 218 within the base assembly 203. The outer perimeter of the tray assembly 218 is less than an inner perimeter of the base assembly 203, such as to form the cooling passage 215 between one or more pairs of tray sidewalls 211 and base sidewalls 202. In some embodiments, the cooling passage 215 substantially circum-scribes or surrounds an outer perimeter of the tray assembly 218. The base wall 204 forms a lower or bottom closed face of the cooling passage 215. A cooling passage cover 212 forms a removable top face over the cooling passage 215. For instance, the cooling passage cover 212 includes a wall 216 extending from tray sidewalls 211 to base sidewalls 202, such as to provide a cover over the cooling passage 215.

Figure 4:
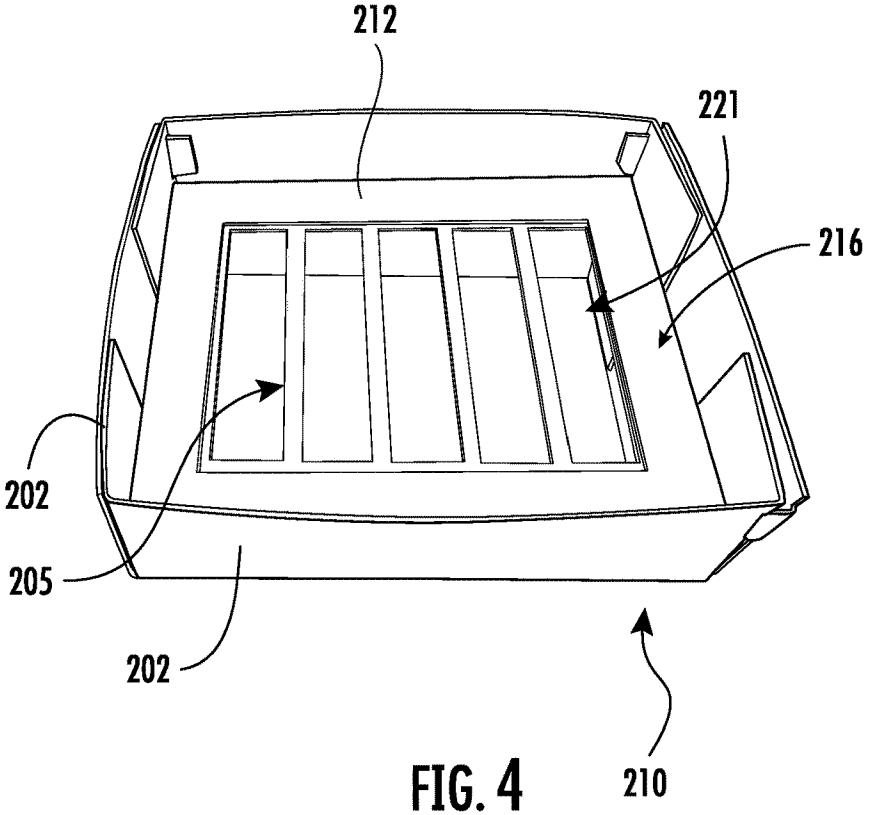
FIG. 4 depicts a perspective view of an exemplary embodiment of a container assembly in accordance with aspects of the present disclosure.
Figure 3:
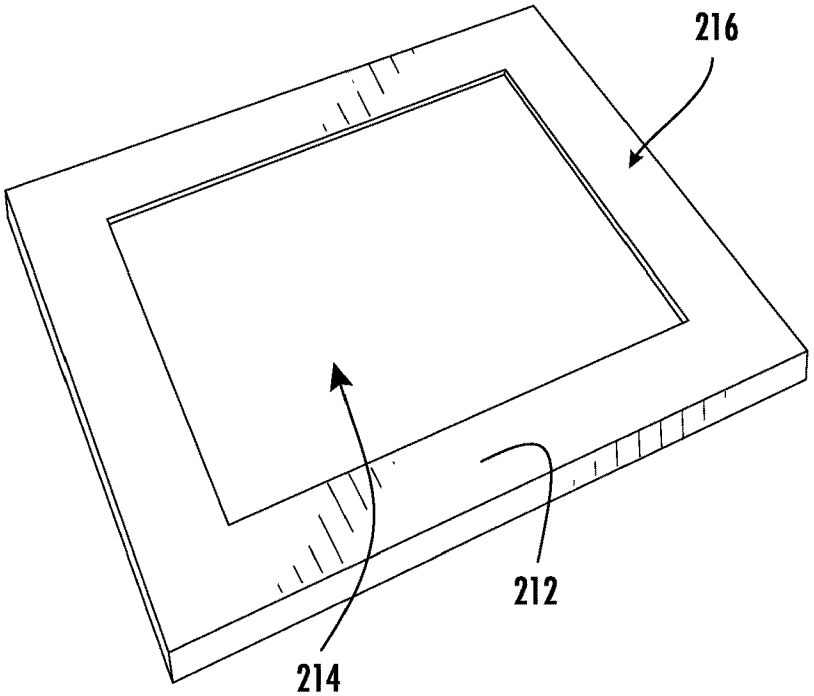
FIG. 3 depicts a perspective view of an exemplary embodiment of a cooling passage cover of the container assembly in accordance with aspects of the present disclosure.
Figure 5:
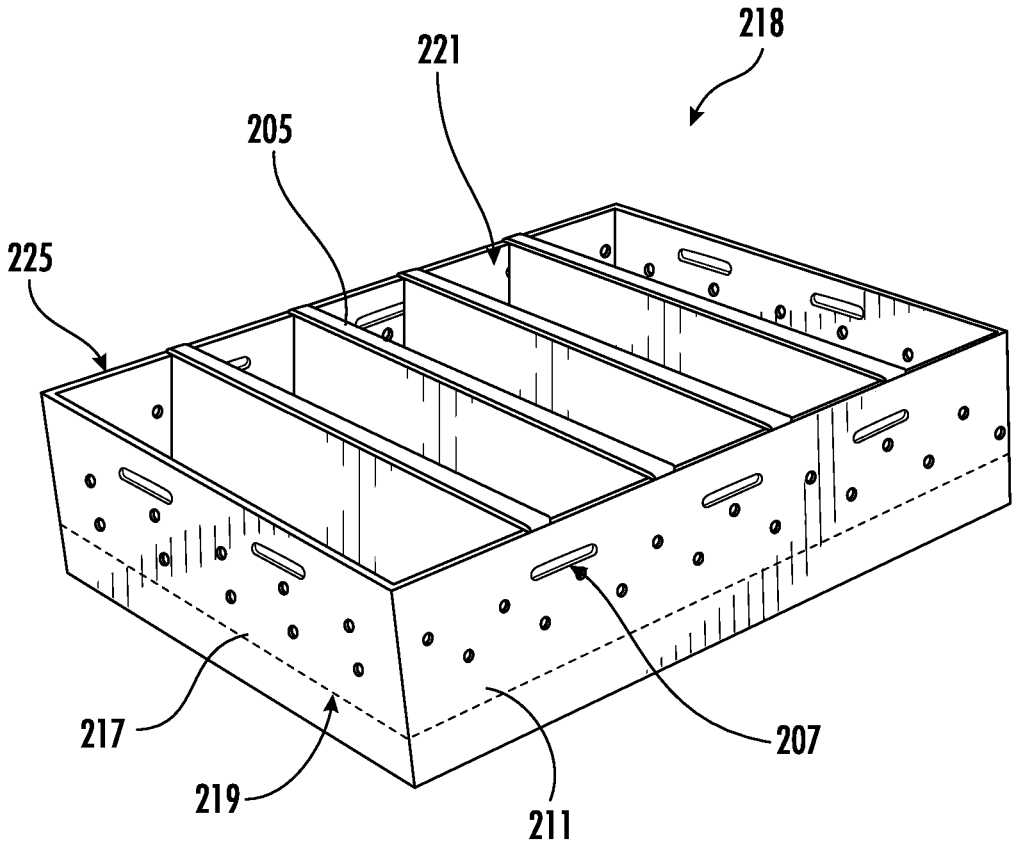
FIG. 5 depicts an exemplary embodiment of a tray assembly of the container assembly in accordance with aspects of the present disclosure.

Referring to FIGS. 3-4, in some embodiments, the cooling passage cover 212 forms an opening 214 corresponding substantially to an area of the interior volume 221 extending between the tray sidewalls 211, such as to allow user access to contents at the interior volume 221 while forming a barrier between the user and cooling material at the cooling passage 215.

Figure 7:
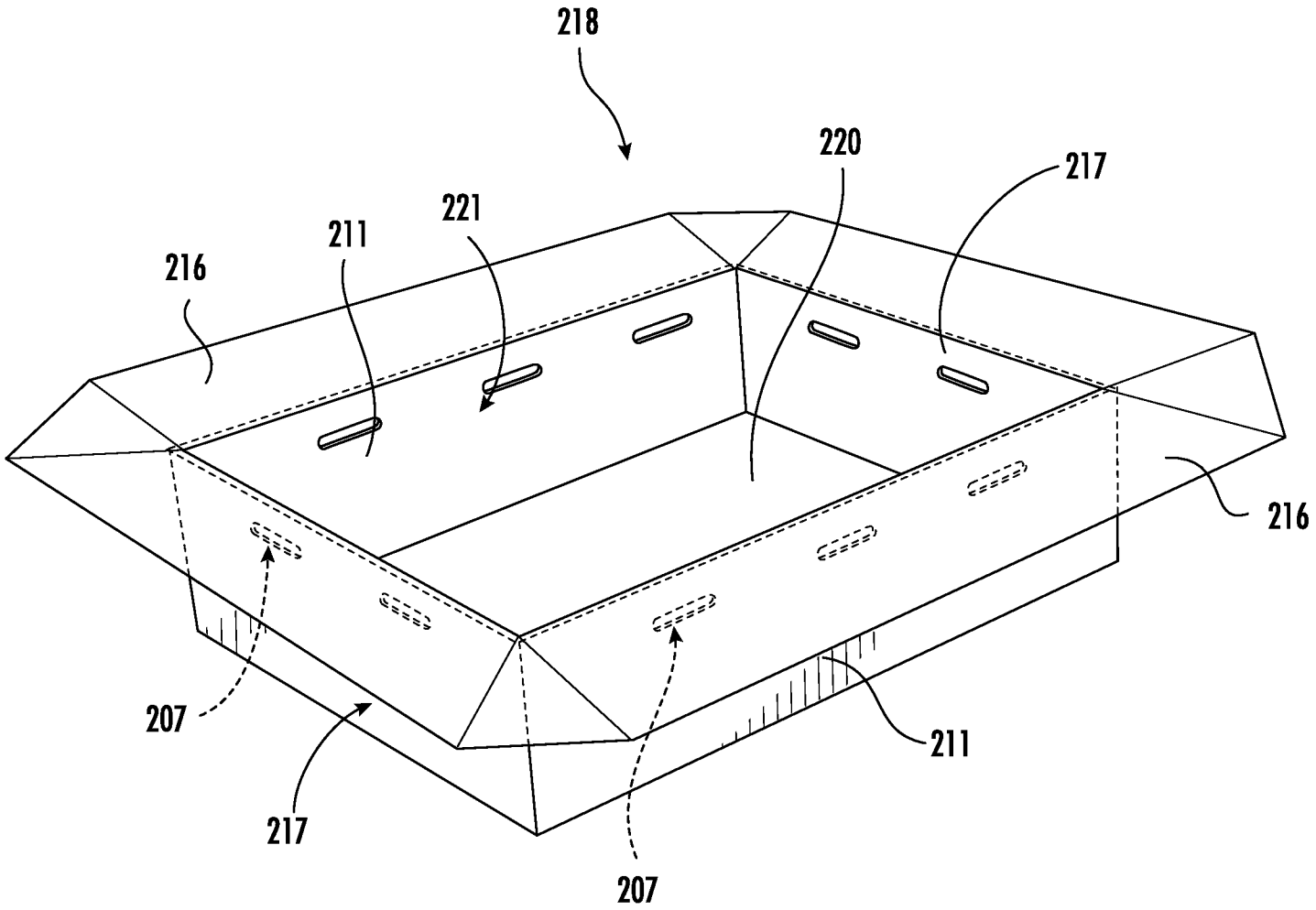
FIG. 7 depicts an exemplary embodiment of a tray assembly and cooling passage cover of the container assembly in accordance with aspects of the present disclosure.

Referring briefly to FIG. 7, in some embodiments, the walls 216 of the cooling passage cover 212 are integrated to tray sidewalls 211, or tray endwalls 217, at the tray assembly 218. Walls 216 may form flaps extendable to the base sidewalls 202.

Referring to FIGS. 1-9, in various embodiments, a spacing between the sidewalls 202, 211 is configured to form the cooling passage 215 to allow a cooling material (e.g., dry ice or $CO_2$ ice, $H_2O$ ice or ice from water or water-based solution, a cooling pack (e.g., a material subjected to desirably cold temperatures and configured to exchange heat with a surrounding environment over a period of time), pellet ice, nugget ice, cube ice, wedge ice, etc., or combinations thereof) to be placed in the cooling passage 215. The base wall 204 and sidewalls 202, 211 retain the cooling material within the cooling passage 215.

The cooling passage cover 212 is placeable, insertable, attachable, or removably positionable at an upper lip 225 of the tray assembly 218, such as to provide a removable top face or cover to enclose the cooling passage 215. The walls 216 may extend and retract from the upper lip 225 toward the base sidewalls 202. The cooling passage cover 212, or walls 216 extending over the cooling passage 215, may obscure the cooling material at the cooling passage 215, such as to form a barrier between a user and the cooling material. For instance, the removable cooling passage cover 212 may allow a user to place, and re-fill or exchange, the cooling material at the cooling passage 215 and further limit physical contact between a user and the cooling material. The cooling passage cover 212 may further limit heat transfer between the cooling material and air above the base assembly 203.

In various embodiments, a fluid circulation opening 207 is formed through one or more of the tray sidewalls 211. The opening 207 is configured to allow fluid communication between the cooling passage 215 and the interior volume 221 at the tray assembly 218. For instance, cooling material at the cooling passage 215 removes heat from air at the cooling passage 215. The opening 207 allows cooled air at the cooling passage 215 to enter the interior volume 221 at the tray assembly 218. In some embodiments, dry ice at the cooling passage 215 removes heat from air at the cooling passage 215 and allows cool gases (e.g., air and/or carbon dioxide) at the cooling passage 215 to enter the interior volume 221 at the tray assembly 218.

In various embodiments, the plurality of tray sidewalls 211 includes tray endwalls 217. For instance, the endwalls 217 may be separated along a longitudinal direction from one another and form a lesser length than the sidewalls 211 extending between the endwalls 217. In some embodiments, the fluid circulation opening 207 is formed through the tray end walls 217. In still some embodiments, the fluid circulation openings 207 are distributed across each sidewall 211 around the perimeter of the tray assembly 218. In some embodiments, the tray assembly 218 includes a partition wall 205 extending through the interior volume 221 at the tray assembly 218. One or more of partition walls 205 may divide the interior volume 221 into a plurality of interior volumes between the tray sidewalls 211. The partition wall 205 may be removably positioned, such as to separate different foods or other contents from one another.

In some embodiments, the fluid circulation opening 207 is positioned through the sidewall 211 or endwall 217 corresponding to the interior volume 221, or each of the plurality of interior volumes 221. For instance, the tray assembly 218 may include at least one opening 207 extending into each interior volume 221 formed between the partition wall 205 and the sidewalls 211 or endwalls 217.

In still some embodiments, a fill line 219 is defined extending along a length and width of the tray sidewalls 211. The fill line 219 may be a marking, etching, raised material, indentation, or other indicator to the user of a maximum level to position the cooling material (e.g., a maximum level at which ice is filled in the cooling passage 215). In some embodiments, the fill line 219 is positioned at approximately 40% of a distance from the tray base wall 220 and an upper lip 225 of the tray sidewall 211. In still some embodiments, the fill line 219 is positioned at approximately 50%, or approximately 60%, or approximately 70%, or approximately 80% of the distance from the tray base wall 220 to the upper lip 225 of the tray sidewall 211. In various embodiments, the fluid circulation opening 207 is positioned through the tray sidewalls 211 above the fill line 219. In some embodiments, the fluid circulation opening 207 is positioned through the tray endwalls 217 above the fill line 219. For instance, the fluid circulation opening 207 may be positioned proximate to the upper lip 225 of the tray assembly 218. In various embodiments, the fluid circulation opening 207 is positioned above 40% of the distance from the tray base wall 220 to the upper lip 225, or above 50% of the distance, or above 60% of the distance, or above 70% of the distance, or above 80% of the distance from the tray base wall 220 to the upper lip 225 of the tray sidewall 211.

Positioning the fluid circulation opening 207 above the fill line 219 may allow for fluid and thermal communication between the fluid passage 215 and the interior volume 221. In various embodiments, the fluid circulation opening 207 above the fill line 219 may balance heat transfer (e.g., reduce a thermal gradient) between the cooling passage 215 and interior volume 221 above the fill line 219 in contrast to below the fill line 219. For instance, food and contents, or air surrounding food, adjacent to the cooling material at or below the fill line 219 may undergo greater heat transfer than food and contents above the fill line 219, such as due to proximity to the cooling material. The fluid circulation opening 207 above the fill line 219 may allow for heat transfer to food and contents, or surrounding air, at the interior volume 221, such as to reduce the thermal gradient and allow for more even cooling between upper and lower portions of the interior volume 221.

In various embodiments, the fluid circulation opening 207 includes holes, elon-gated slots, slits, or perforations. The opening 207 may extend longitudinally, vertically, or along an oblique angle therebetween. Pluralities of openings 207 may be arranged in longitudinally adjacent arrangement, in vertically adjacent arrangement, or combinations thereof.

Figure 6:
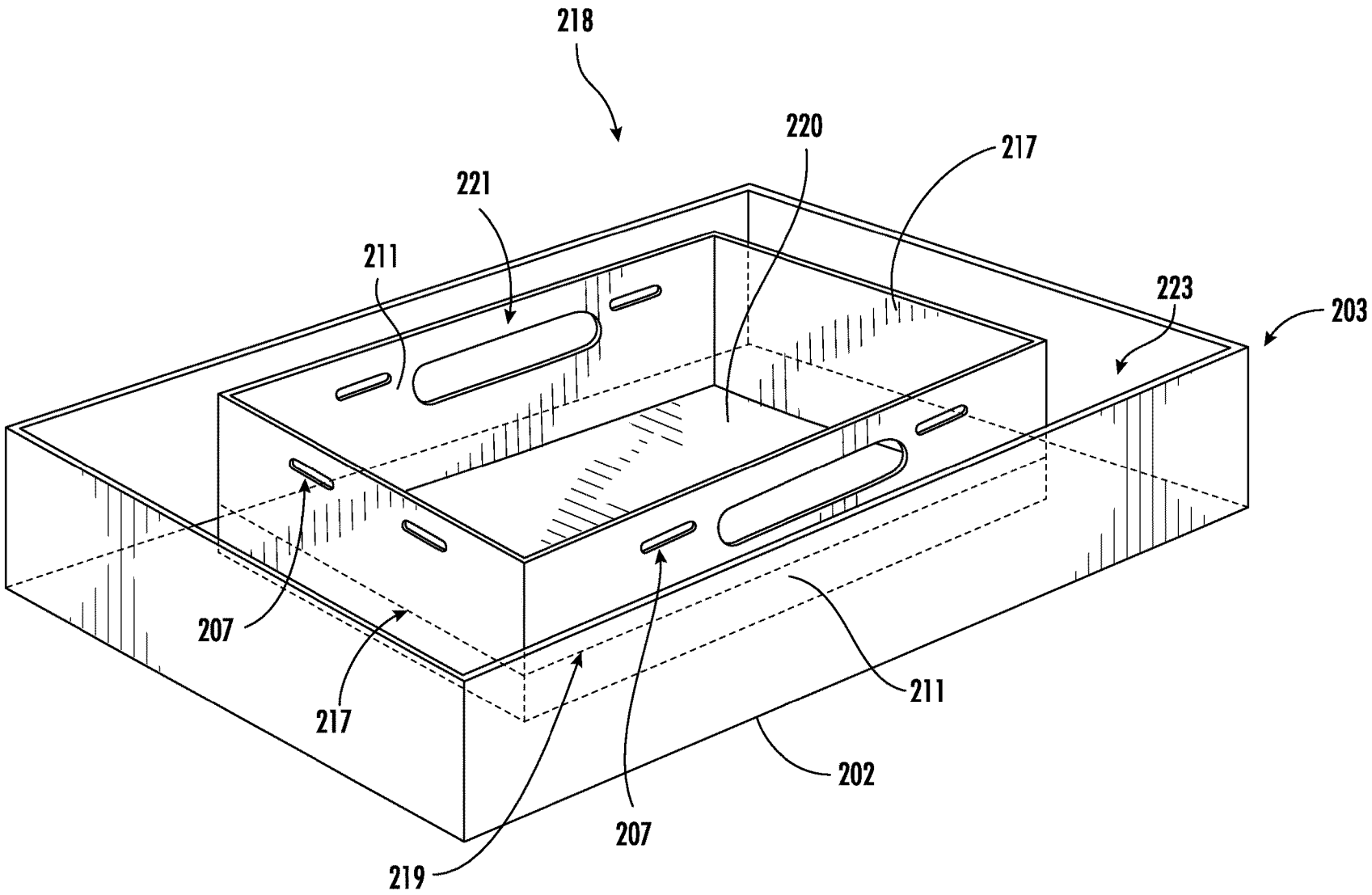
FIG. 6 depicts an exemplary embodiment of components of a container assembly in accordance with aspects of the present disclosure.

Referring briefly to FIG. 6, in some embodiments, the tray assembly 218 includes one or more fluid circulation openings 207 configured to allow a user to extend fingers into the opening 207, such as to pick up the tray assembly 218.

Figure 8:
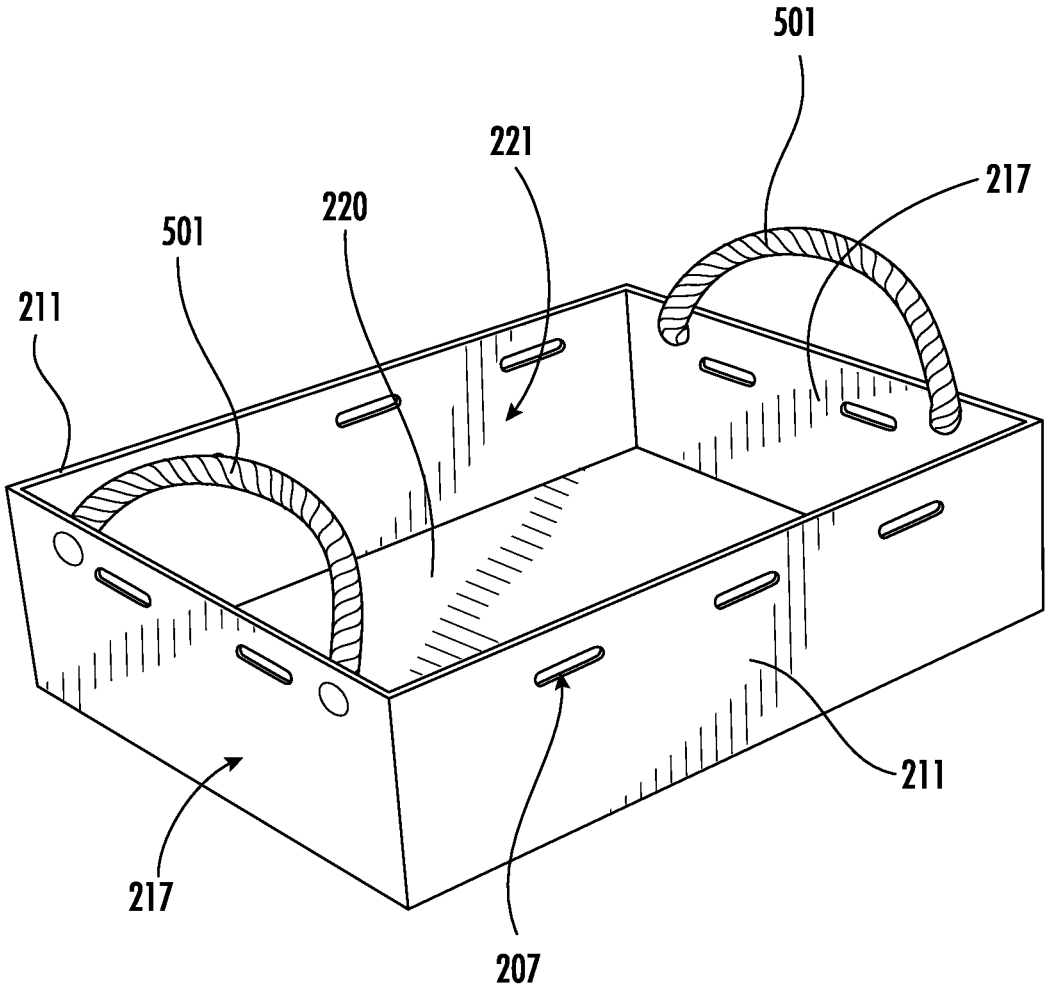
FIG. 8 depicts an exemplary embodiment of a tray assembly of the container assembly in accordance with aspects of the present disclosure.

Referring now to FIG. 8, in still some embodiments, the tray assembly 218 includes a handle 501 extending from the tray sidewall 211. For instance, the handle 501 may extend from the tray endwalls 217, such as to facilitate a user to position or remove the tray assembly 218 to and from the base assembly 203. In some embodiments, the container assembly 210 includes an embodiment of the tray assembly 218 including the handle 501 (e.g., depicted in FIG. 8) and an embodiment of the tray assembly 218 without the handle. The tray assemblies 218 may rest substantially flush with one another along the sidewalls 211, such as to form a double-wall structure. In various embodiments, the tray assemblies 218 include the fluid circulation openings 207 positioned at substantially the same locations as one another, such as to permit fluid communication and thermal communication between the cooling passage 215 and the interior volume 221. Food may be placed into the tray assembly 218 including the handle 501, and the tray assembly 218 including the handle 501 may be positioned or removed from within the other tray assembly 218. Such embodiments may allow the tray assembly 218 including food in the tray assembly 218 to be removed from the container assembly 210 without removing the walls forming the cooling passage 215. Accordingly, substantially the same container assembly 210 may be used and re-used by removing and replacing tray assemblies 218 while retaining the base assembly 203 and cooling material in the cooling passage 215.

In some embodiments, the base assembly 203 includes a handle 601 extending from the base sidewall 202. For instance, the handle 601 may extend endwalls of the base sidewalls 202, such as to facilitate a user to hold and transport the container assembly 210. In some embodiments, the container assembly 210 includes an embodiment of the base assembly 203 including the handle 601 (e.g., depicted in FIG. 9) and an embodiment of the base assembly 203 without the handle. The base assemblies 203 may rest substantially flush with one another along the sidewalls 202, such as to form a double-wall structure.

Figure 9:
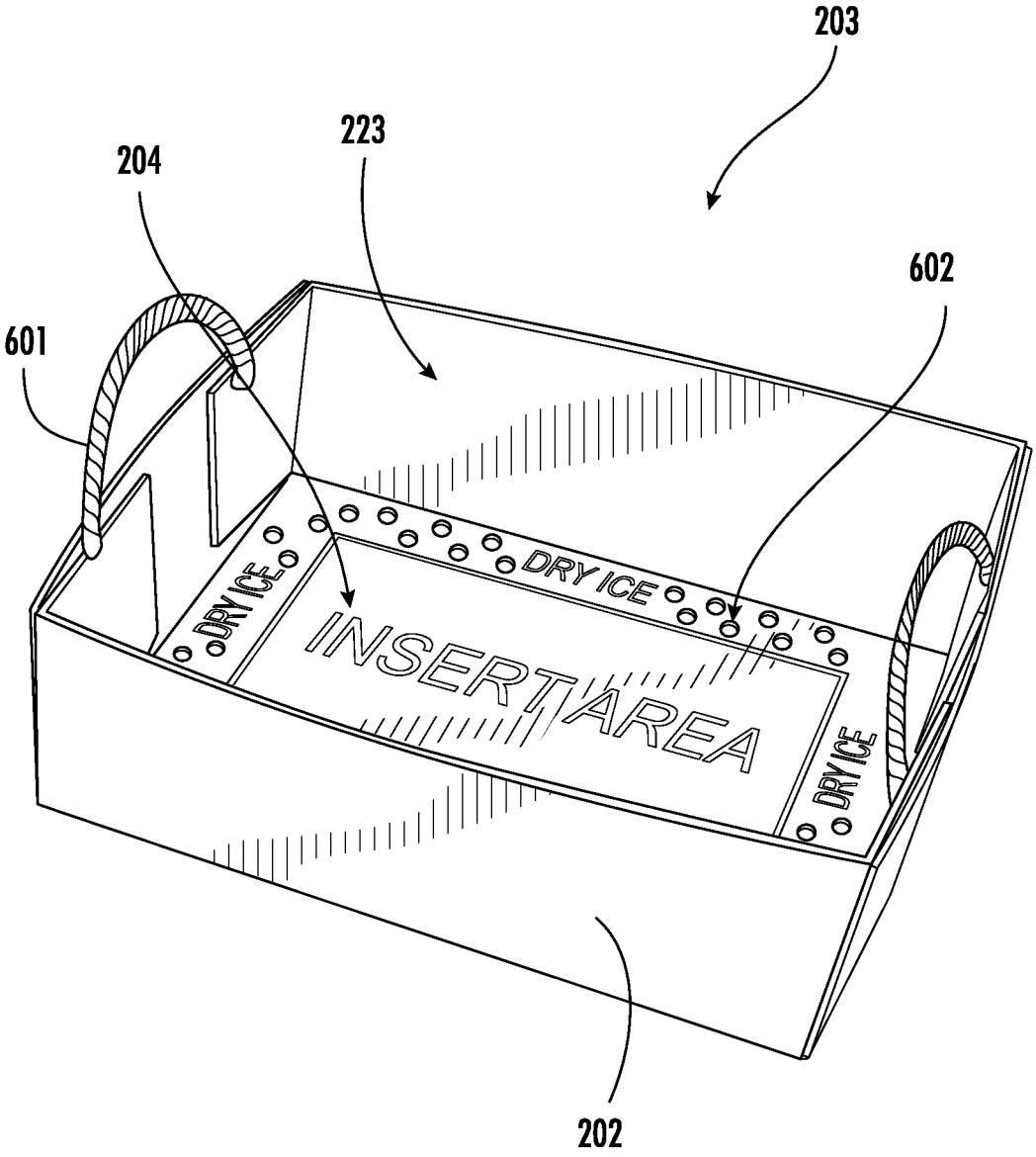
FIG. 9 depicts an exemplary embodiment of a base assembly of the container assembly in accordance with aspects of the present disclosure.

Referring to FIG. 9, in still some embodiments, the base assembly 203 includes a drain opening 602 extending through the base wall 204. For instance, the drain opening 602 may extend through the base wall 204 at the cooling passage 215. The drain opening 602 may allow melted ice or other liquid fluid may drain through base wall 204. In some embodiments, an embodiment of the base assembly 203 including the drain opening 602 may be positioned inside an embodiment of the base assembly 203 without the drain opening. Liquid may drain through the drain opening 602 of a first base assembly onto the base wall 203 of a second base assembly. A user may separate the base assemblies from one another as desired, such as to facilitate draining or prevent accumulation of liquid at the base wall 203.

Embodiments of the base assembly 203, the tray assembly 218, or both, may be constructed of wood or paper product, such as, but not limited to, cardboard, corrugated fiberboard, paperboard, mat board, chipwood or particle board, composite paper or wood product, or plant-based materials or fibers (e.g., cotton, hemp, etc.), wax or wax-based material, or recyclable and/or biodegradable materials generally, or combinations thereof. Still further components depicted and described herein, such as the cooling passage cover 212, the container cover 222, or partition wall 205 may be formed of one or more materials such as provided herein. Thicknesses of walls depicted and described herein may range from approximately thirteen (13) millimeters (mm) to approximately 0.6 mm. Walls depicted and described herein may include single wall or double wall structures, or single or multiple plies positioned adjacent to one another.

It should be appreciated some embodiments of the container assembly 210 provided herein may include vinyl, polymer (e.g., thermoplastics, polystyrene, expanded polystyrene, polycarbonate, compostable plastic, etc.), nanotexture material, nanofilm material, or metal (e.g., aluminum, stainless steel, etc.), or combinations thereof.

Various embodiments of a method for transporting and/or displaying food, or constructing a container for displaying and/or transporting food, include forming one or more walls corresponding to the base assembly 203, the tray assembly 218, and the cooling passage cover 212 such as described herein. The method may include positioning one or more cooling materials such as described herein in the cooling passage formed via steps of the method forming the base walls and sidewalls at the base assembly and tray assembly. Steps of the method may include forming one or more fluid circulation openings through a sidewall forming an interior volume of the tray assembly. Steps of the method may include Steps of the method may include generating fluid communication between the cooling passage and an interior volume of the tray assembly. Additionally, or alternatively, steps of the method may include forming one or more fluid circulation openings having a range of positions such as described herein. Steps of the method may further include forming the walls in accordance with thicknesses, or ranges thereof, or plies such as described herein.

Embodiments of the container assembly 210, method for constructing the container assembly, and method for insulating food such as depicted and described herein provide a transportation and display container for food, or furthermore, apparatuses for transporting and displaying food and configured to execute steps for cooling food, or maintaining cooling at food, at the apparatus. Embodiments depicted and described herein may provide insulating and cooling for food positioned at the tray assembly 218. Embodiments of the container assembly 210 may mitigate or eliminate flooding, spillage, or seepage of liquids (e.g., melted ice or condensation) onto foods. Embodiments of the container assembly 210 may provide walls separating the food from the cooling material, and separating the cooling material from the user, such as to prevent adverse user contact and food contact (e.g., freezer burn) with the cooling material. Embodiments of the container assembly 210 and methods described herein may provide one or more benefits and advantages described herein while allowing visual and/or physical access to food by a user (e.g., unobstructed or partially obstructed view and physical touch without an intervening medium between the user and the food).

Embodiments of the container assembly 210 may provide one or more benefits described herein without requiring input electricity, such as for operating an active cooling element (e.g., fan, pump, compressor, motor, etc.), such as required with freezer or refrigerator appliances. For instance, embodiments provided herein may require no energy points to operate, such as by providing cooling using a passive cooling element (e.g., ice, ice packs, cooling packs etc.).

Embodiments of the container assembly 210 provided herein may provide advantageously long cooling periods (e.g., greater than 2 hours, or greater than 4 hours, or greater than 6 hours, or greater than 8 hours), such as when surrounded by ambient air environmental conditions (e.g., approximately 80 degrees Fahrenheit or less). Some embodiments of the container assembly 210 may provide advantageously long cooling while allowing food to be exposed outside of the base assembly 203 (e.g., open air, atmospheric air, room temperature air, outdoor air, etc.). Additionally, or alternatively, embodiments provided herein may provide desired cooling or freezing for advantageously long periods without requiring energy inputs, such as required with freezer or refrigerator appliances.

Embodiments of the container assembly 210 may include a container cover 222 configured to surround an open face of the base assembly 203. For instance, the container cover 222 may be configured to rest upon or wrap around the sidewalls 202 at the base assembly 203. In some embodiments, the container cover 222 may include a transparent, semi-transparent, or translucent wall 213 configured to allow a user to at least partially see into the interior volume 221, such as to see food or other contents at the tray assembly 218. Embodiments of the container cover 222 may include materials such as described in regard to the base assembly 203 or tray assembly 218. The transparent or translucent wall 213 may include any appropriate material through which may be seen through by a user. Embodiments of the container assembly 210 may provide cover over food at the tray assembly 218, or may further provide insulating and cooling advantages.

In some embodiments, base sidewalls 202 may extend over tray sidewalls 211, such as to have a greater height at the base sidewalls 202 than the tray sidewalls 211. For instance, base sidewalls 202 may receive the container cover 222 and leave volume between the container cover 222 and the upper lip 225 at the tray assembly 218. Food or other contents may extend above the upper lip 225 and remain below the container cover 222.

Embodiments of the container assembly 210 provided herein may provide advantages of durable, reusable containers while being constructed of biodegradable and/or recyclable materials, or other materials appropriate for disposable use. The container assembly 210 may include colors, films, coatings, or other features that may mitigate undesired heat exchange, such as may be configured to reflect light or reject heat absorption from outside of the container assembly 210.

It should be appreciated that embodiments of the container assembly 210 provided herein may be configured with substantially rectangular cross sections, such as depicted herein. Additionally, or alternatively, embodiments of the container assembly 210 may be configured to substantially circular, ovular, elliptical, trapezoidal, or other polygonal cross sections. For instance, in various embodiments, the base wall 204 may form a cross section such as provided above. The tray assembly 218 may include the tray base wall 220 having a corresponding cross section. Sidewalls 202, 211 may curve correspondingly to a circular, ovular, elliptical, etc. base wall 204, 220. Walls 216 may furthermore correspond to the area or perimeter of the cooling passage 215 formed between the sidewalls 202, 211.

The following provides exemplary dimensions of a container assembly configured or constructed in accordance with aspects of the present disclosure. It should be appreciated that one skilled in the art may modify, adjust, increase, decrease, scale, or re-proportion the container assembly without deviating from the scope of the present disclosure. In an embodiment, the container assembly includes the base sidewalls separated from the tray sidewalls by approximately 2.5 inches. The container assembly may include the base sidewalls approximately 20 inches apart from one another along a length, and the base sidewalls approximately 16.5 inches apart from one another along a width. The base sidewalls may extend approximately 8 inches in height from the base wall. The tray endwalls may be positioned approximately 15 inches apart from one another along a length, and the tray sidewalls may be positioned approximately 11 inches apart from one another along a width. The tray assembly may include the tray sidewalls extending approximately 7 inches in height from the tray base wall 220. Still other embodiments of the container assembly may be configured or constructed having dimensions equal to, less than, or greater than those provided in the foregoing.

Further aspects of the invention are provided by one or more of the following embodiments:

1. A container assembly for food, foodstuffs, or organic matter, the container assembly including a base assembly, the base assembly including a base wall and a base sidewall, the base wall and the base sidewall together forming a base interior volume at which a tray assembly is positionable; the tray assembly including a tray base wall and a tray sidewall, the tray base wall and the tray sidewall together forming a tray interior volume, wherein a cooling passage is formed between the tray sidewall and the base sidewall; a cooling passage cover wall removably positionable to extend between the tray sidewall and the base sidewall over the cooling passage; and an opening extending through the tray sidewall, the opening providing fluid communication between the cooling passage and the tray interior volume.
2. The container assembly of any one or more clauses herein, wherein the cooling passage is formed between the tray sidewall, the base sidewall, and the base wall and having an open top face through which a cooling material is receivable into and retained within the cooling passage.
3. The container assembly of any one or more clauses herein, wherein the cooling passage cover wall forms a removable top face over the cooling passage.
4. The container assembly of any one or more clauses herein, the container assembly including a partition wall positioned at the tray interior volume, the partition wall configured to divide the tray interior volume into two or more tray interior volumes.
5. The container assembly of any one or more clauses herein, the opening extending through the tray sidewall to provide fluid communication between each tray interior volume and the cooling passage.
6. The container assembly of any one or more clauses herein, wherein the opening is a hole, a slot, a slit, or a perforation.
7. The container assembly of any one or more clauses herein, the tray assembly including a handle extending from the tray sidewall.
8. The container assembly of any one or more clauses herein, the base assembly including a handle extending from the base sidewall.
9. The container assembly of any one or more clauses herein, the base assembly including a drain opening extending through the base wall at the cooling passage.
10. The container assembly of any one or more clauses herein, wherein the base assembly, the tray assembly, or both includes cardboard, corrugated fiberboard, paperboard, mat board, wood, composite paper or wood product, paper products, recyclable materials, or biodegradable materials, or combinations thereof.
11. The container assembly of any one or more clauses herein, wherein the opening is positioned at a distance between approximately 40% from the tray base wall and an upper lip of the tray sidewall.
12. The container assembly of any one or more clauses herein, the container assembly including a container cover configured to surround an open face of the base assembly.

13. The container assembly of any one or more clauses herein, the container cover including a transparent or translucent wall.
14. The container assembly of any one or more clauses herein, the opening position at an upper half of the tray side wall.
15. A container assembly for food, foodstuffs, or organic matter, the container assembly including a base assembly, the base assembly including a base wall and a plurality of base sidewalls, the base wall and the plurality of base sidewalls together forming a base interior volume at which a tray assembly is positionable; the tray assembly including a tray base wall and a plurality of tray sidewalls, the tray base wall and the plurality of tray sidewalls together forming a tray interior volume, wherein a cooling passage is formed between one or more pair of tray sidewall and base sidewall; a cooling passage cover wall removably positionable to extend over the cooling passage; and an opening extending through one or more of the tray sidewalls, the opening providing fluid communication between the cooling passage and the tray interior volume.
16. The container assembly of any one or more clauses herein, the plurality of tray sidewalls including a pair of endwalls separated from one another along a longitudinal direction, wherein the endwalls form a length less than the tray sidewalls extending between the endwalls.
17. The container assembly of any one or more clauses herein, wherein the opening is positioned at the endwalls.
18. The container assembly of any one or more clauses herein, wherein the base assembly, the tray assembly, or both include cardboard, corrugated fiberboard, paperboard, mat board, wood, composite paper or wood material, plant-based fiber, or combinations thereof.
19. A method for displaying food in a cooling environment, the method including forming, from a cardboard, corrugated fiberboard, paperboard, mat board, wood, composite paper or wood material, plant-based fiber, or combinations thereof, a base interior volume from a base assembly including a base wall and a base sidewall; forming, from a cardboard, corrugated fiberboard, paperboard, mat board, wood, composite paper or wood material, or combinations thereof, a tray interior volume from a tray assembly including a tray base wall and a tray sidewall; forming a cooling passage between the tray sidewall and the base sidewall; and generating fluid communication between the cooling passage and the tray interior volume via extending an opening through the tray sidewall.
20. The method of any one or more clauses herein, the method including positioning a cooling medium at the cooling passage at or below a fill line, the cooling medium including one or more of $H_2O$ ice, $CO_2$ ice, or a cooling pack, the fill line extending along a length or width less than approximately 80% of a height between an upper lip of the tray sidewall and the tray base wall.
21. The method of any one or more clauses herein, the method including positioning a cooling medium at the cooling passage at or below a fill line, the cooling medium including one or more of $H_2O$ ice, $CO_2$ ice, or a cooling pack, the fill line extending along a length or width greater than approximately 40% of a height between an upper lip of the tray sidewall and the tray base wall.
22. A method for constructing a container, the method including forming, from a cardboard, corrugated fiberboard, paperboard, mat board, wood, composite paper or wood material, plant-based fiber, or combinations thereof, a base interior volume from a base assembly including a base wall and a base sidewall; forming, from a cardboard, corrugated fiberboard, paperboard, mat board, wood, composite paper or wood material, or combinations thereof, a tray interior volume from a tray assembly including a tray base wall and a tray sidewall; forming a cooling passage between the tray sidewall and the base sidewall; and forming an opening extending through the tray sidewall from the cooling passage to the interior volume.
23. The method of any one or more clauses herein, wherein forming the opening is between approximately 40% and approximately 80% of a height between an upper lip of the tray sidewall and the tray base wall.
24. A method for constructing a freezer or refrigeration container, the method including the method of any one or more clauses herein.
25. A method for constructing a container including the method of any one or more clauses herein and the container of any one or more clauses herein.
26. A container for foodstuffs, the container including the container of any one or more clauses herein.

This written description uses examples to disclose the subject matter, including the best mode, and also to enable any person skilled in the art to practice the subject matter, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A container assembly for food or foodstuffs, the container assembly comprising:

a base assembly comprising a base wall and a base sidewall, the base wall and the base sidewall together forming a base interior volume at which a tray assembly is positionable;

the tray assembly comprising a tray base wall and a tray sidewall, the tray base wall and the tray sidewall together forming a tray interior volume, wherein an area between the tray sidewall and the base sidewall forms a cooling passage;

a cooling passage cover wall corresponding to the area forming the cooling passage, the cooling passage cover wall extendable between the tray sidewall and the base sidewall to removably obscure the cooling passage, the cooling passage cover wall removable while the tray assembly is positioned in the base assembly;

an opening extending through the tray sidewall, the opening providing fluid communication between the cooling passage and the tray interior volume; and a container cover configured to surround an open face of the base assembly.

2. The container assembly of claim 1, wherein the cooling passage is formed between the tray sidewall, the base sidewall, and the base wall, wherein a cooling material is receivable into and retained within the cooling passage.

3. The container assembly of claim 1, wherein the cooling passage cover wall forms a removable top face configured to obscure the cooling passage when extended between the tray sidewall and the base sidewall.

4. The container assembly of claim 1, the container assembly comprising:

a partition wall positioned at the tray interior volume, the partition wall configured to divide the tray interior volume into two or more tray interior volumes.

5. The container assembly of claim 4, the opening extending through the tray sidewall to provide fluid communication between each tray interior volume and the cooling passage.

6. The container assembly of claim 1, wherein the opening is a hole, a slot, a slit, or a perforation.

7. The container assembly of claim 1, wherein the base assembly, the tray assembly, or both comprises cardboard, corrugated fiberboard, paperboard, mat board, wood, composite paper or wood product, paper products, recyclable materials, or biodegradable materials, or combinations thereof.

8. The container assembly of claim 1, wherein a reference distance extends between the tray base wall and an upper lip of the tray sidewall, wherein the tray base wall corresponds to 0% distance, and wherein the upper lip corresponds to 100% distance, and wherein the opening is positioned along the reference distance 40% or greater from the tray base wall.

9. The container assembly of claim 1, the container cover comprising a transparent or translucent wall.

10. The container assembly of claim 1, the opening positioned at an upper half of the tray side wall.

11. A container assembly for displaying and transporting food, foodstuffs, or organic matter, the container assembly comprising:

a base assembly comprising a base wall and a plurality of base sidewalls, the base wall and the plurality of base sidewalls together forming a base interior volume at which a tray assembly is positionable;

the tray assembly comprising a tray base wall and a plurality of tray sidewalls, the tray base wall and the plurality of tray sidewalls together forming a tray interior volume, wherein an area between the plurality of tray sidewalls and the base sidewall forms a cooling passage;

a cooling passage cover wall corresponding to the area forming the cooling passage, the cooling passage cover wall extendable between the base sidewall and one or more of the tray sidewalls to obscure the cooling passage without obscuring an open top face over the tray interior volume, the cooling passage cover wall removable while the tray assembly is positioned in the base assembly; and an opening extending through one or more of the tray sidewalls.

12. The container assembly of claim 11, the plurality of tray sidewalls comprising a pair of endwalls separated from one another along a longitudinal direction, wherein the endwalls form a length less than the tray sidewalls extending between the endwalls.

13. The container assembly of claim 12, wherein the opening is positioned at the endwalls.

14. The container assembly of claim 11, wherein the base assembly, the tray assembly, or both comprise cardboard, corrugated fiberboard, paperboard, mat board, wood, composite paper or wood material, plant-based fiber, or combinations thereof.

15. The container assembly of claim 11, wherein the cooling passage is formed between the tray sidewall, the base sidewall, and the base wall, wherein a cooling material is receivable into and retained within the cooling passage.

16. The container assembly of claim 11, wherein a reference distance extends between the tray base wall and an upper lip of the tray sidewall, wherein the tray base wall corresponds to 0% distance, and wherein the upper lip corresponds to 100% distance, and wherein the opening is positioned along the reference distance 40% or greater from the tray base wall.

17. The container assembly of claim 11, the container assembly comprising:

a container cover configured to surround an open face of the base assembly.

18. The container assembly of claim 11, wherein the cooling passage cover wall extends from the tray sidewall to the base sidewall to provide the cover over the cooling passage.

19. The container assembly of claim 1, wherein the cooling passage cover wall extends from the tray sidewall to the base sidewall to provide the cover over the cooling passage.

* * * * *